US006424257B1

(12) United States Patent
Slater et al.

(10) Patent No.: US 6,424,257 B1
(45) Date of Patent: Jul. 23, 2002

(54) BIDIRECTIONAL COMMUNICATION BETWEEN CONTROL ELEMENT AND ELECTRICAL DEVICES

(75) Inventors: James S. Slater, Maple Park; Hsing C. Jen, Buffalo Grove; Timothy A. Rauworth, Aurora, all of IL (US)

(73) Assignee: Pittway Corporation, Chicago, IL (US)

( * ) Notice: Subject to any disclaimer, the term of this patent is extended or adjusted under 35 U.S.C. 154(b) by 0 days.

(21) Appl. No.: 09/551,379

(22) Filed: Apr. 18, 2000

(51) Int. Cl.[7] ..... G08B 29/00
(52) U.S. Cl. ..... 340/506
(58) Field of Search ..... 340/511, 501, 340/518, 3.1

(56) References Cited

U.S. PATENT DOCUMENTS 4,916,432 A 4/1990 Tice et al.
5,117,219 A 5/1992 Tice et al.
5,525,962 A 6/1996 Tice
5,546,074 A 8/1996 Bernal et al.
5,708,414 A 1/1998 Peltier et al.
5,736,928 A * 4/1998 Tice et al. ..... 340/511

* cited by examiner

*Primary Examiner*—Daryl Pope
(74) *Attorney, Agent, or Firm*—Welsh & Katz, Ltd.

(57) ABSTRACT

A software driven monitoring system includes a common control element coupled to a plurality of monitoring devices. The devices can indicate to the control element that a predetermined condition has been detected. Where the control element transmits a status inquiry command to the devices, those devices exhibiting the status provide the same indication to the control element as is indicative of the predetermined condition. One indication is a shunt or a short circuit of a medium between the common control element and the devices. An existing system can be upgraded by installing the control element, or upgrading an existing control program. Alternately, the devices can be installed in a system wherein the control element does not issue the status inquiry command. In those installations, the monitoring devices never issue a status reply as the required command is never received.

25 Claims, 1 Drawing Sheet

BIDIRECTIONAL COMMUNICATION BETWEEN CONTROL ELEMENT AND ELECTRICAL DEVICES

FIELD OF THE INVENTION

The invention pertains to monitoring systems. More particularly, the invention pertains to ambient condition monitoring systems such as fire alarm systems.

BACKGROUND OF THE INVENTION

Region monitoring systems have been found to be useful when installed in buildings to monitor various on-going conditions in one or more regions of the building. Examples of these include fire alarm systems and burglar alarm systems. In addition to such systems which are usable in commercial or industrial establishments, it has been recognized that such systems, in an appropriate form, can be usefully installed in residences or small non-residential buildings.

Known residential alarm systems, in one form, include a common control element coupled by a hardwire communications link to a plurality of spaced-apart electrical units. The electrical units can include, for example, smoke detectors, intrusion detectors or the like. The electrical units can also include, if desired, output circuitry to energize alarms or to generate outgoing messages for the purpose of seeking assistance such as from a remote monitoring center or the like.

Many of the known, installed, types of residential systems have exhibited relatively limited types of communication between the common control element and the detectors or other electrical units which are coupled to the cable or communications medium. For example, systems are known wherein detectors monitoring an ambient condition, exhibit an output indicative of that condition by causing a particular current or voltage to appear on or in the communications medium. In the case where the detectors are coupled to a common control element by an electrical cable, a detector exhibiting a selected state, such as an alarm state, could cause a current to flow in the cable. The control element, upon detecting that current flow is able to establish that at least one of the detectors in the system is exhibiting an alarm state.

Typically such detectors latch into an alarm state until the control element produces a reset signal. One known way of establishing a reset is to interrupt power to the communications medium which in turn causes all of the detectors and/or electrical units coupled thereto to reset themselves.

Some of the known systems utilized established two-wire communications mediums and compatible two-wire devices. Other known systems use four-wire communications mediums with compatible four-wire devices. Known systems very often have been evaluated by a certification organization for purposes of performance and reliability under predetermined conditions. Maintaining such certification limits changes that can be made to the control element as well as to the detectors or other electrical units coupled to the system.

There continues to be a need to be able to introduce additional flexibility into existing types of residential alarm systems. Preferably, such flexibility could be introduced without requiring recertification and without introducing additional installation complexity or limiting the number of devices coupled to the system. In addition, it would be preferable if any devices responsive to such expanded capabilities were also downward compatible and functioned appropriately in known installed systems.

SUMMARY OF THE INVENTION

In accordance with the invention, a control element of a monitoring system can determine if any of the devices coupled to the system are in a predefined state. This determination uses the same voltage/current characteristics that a comparable system would exhibit without this expanded functionality.

In accordance herewith, the control element includes a programmed processor as well as interface circuits for communicating, via a communication medium such as electrical or optical cable with the devices. The control element includes executable instructions for forming a status command and transmitting same to the devices in the system.

In one embodiment, the status command can take the form of a sequence of voltage pulses. Other types of status commands can be sent without departing from the spirit and scope of the present invention. The status commands only need to be compatible with the devices coupled to the medium.

In response to receiving a predetermined status command from the control element, each of the devices which is exhibiting the respective status replies substantially immediately to the control element via the medium. The form of the reply corresponds to the same signal sent by the respective device or devices to indicate another predetermined state, such as an alarm condition. Hence, if some of the devices correspond to smoke detectors, for example, the reply to the status command from the control element, from those detectors exhibiting the appropriate status, would be the same electrical signal as would be sent by the respective detector or detectors to indicate the presence of a predetermined ambient condition.

In one aspect of the invention, the reply from the device or devices exhibiting the requested status could be in the form of one or more electrical currents caused by the respective device or devices to flow in the communication medium. For example, in an alarm state, the detector or detectors that have gone into alarm might shunt the medium. Since the responding device or devices each cause a respective current to flow in the medium, the control element can detect the presence of a cumulative current reply indicative of one or more devices which is responding to the status command.

Instructions in the control element, upon detection of the cumulative reply current in the medium, determine that one or more of the devices is exhibiting the respective status. The magnitude of the reply current is indicative of the number of devices exhibiting the status.

Alternately, instead of current, other forms of cumulative electrical or optical signals could be used. Any signal which a device exhibits in response to a predetermined condition can be used as a reply signal to a status request.

In yet another aspect, the control element can include executable instructions for forming a plurality of different commands which can be transmitted, via the medium, to the devices coupled to the system. The commands can be addressed to different conditions or states which might be present at one or more of the devices in the system. The devices need only be capable of replying with the same electrical or optical signal normally used for informing the control element of the presence of a predetermined state or condition.

The present system is particularly advantageous in that the devices are downward compatible with respect to existing previously installed, systems. Additionally, no hardware changes need be made to any of the devices nor to the control element. The control element incorporates executable instructions which provide the commands to be transmitted to the devices seeking status replies.

The devices can include executable instructions for responding to received commands with hardware which can also be used to communicate to the control element the presence of a selected predetermined condition such as fire or intrusion. The devices could also incorporate an ASIC for control.

Numerous other advantages and features of the present invention will become readily apparent from the following detailed description of the invention and the embodiments thereof, from the claims and from the accompanying drawings.

DETAILED DESCRIPTION OF THE PREFERRED EMBODIMENT

Figure 1:
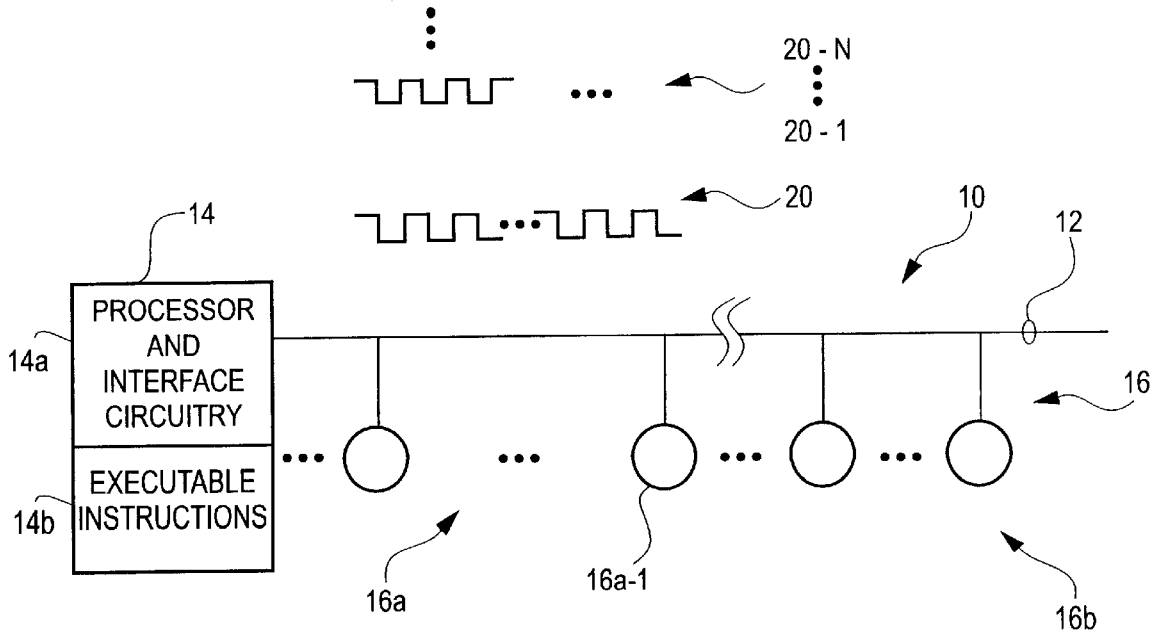
FIG. 1 is an over-all block diagram of a system in accordance with the present invention.

While this invention is susceptible of embodiment in many different forms, there are shown in the drawing and will be described herein in detail specific embodiments thereof with the understanding that the present disclosure is to be considered as an exemplification of the principles of the invention and is not intended to limit the invention to the specific embodiments illustrated.

FIG. 1 illustrates a system 10 which incorporates a communications medium generally indicated at 12. The medium 12 could be, for example, a wired medium such as electrical or optical cable. Alternately, the medium 12 could be a wireless medium such as RF or infrared.

Wired media could include two or four wire cables. In four-wire systems, two wires can be for device commands. Two can be for device feedback.

Coupled to the medium 12 are a control element 14 and a plurality of devices 16. The control element 14 includes a programmed processor and interface circuitry 14*a* and executable instructions 14*b*. The instructions 14*b* can be stored either permanently or temporarily in any conventional form of storage device such as read-only memory, programmable read-only memory or read/write memory.

The devices 16 can include a plurality 16*a* of ambient condition detectors. The detectors can include, without limitation, smoke or fire detectors, intrusion detectors, position detectors, flow detectors, motion detectors, and the like. Such devices usually include at least one ambient condition sensor and processing circuitry whereby under predetermined conditions, signals are coupled to the communication medium 12 from the respective detectors which are indicative of the presence of one or more predetermined conditions.

One of known predetermined conditions is detection of a sufficient indication of fire in a fire detector, which could be a flame, a smoke or a thermal detector, for example, which is indicative of the presence of a fire or an alarm condition. In such instances, a corresponding electrical signal which could be a current signal, a voltage signal, or an optical intensity signal can be coupled to the medium 12 for communication to element 14. Alternately, the detector or detectors which have gone into alarm can shunt or short circuit the medium 12. Element 14 in turn, in response to receiving an alarm indicating signal, can be programmed or hardwired to take appropriate action such as activation of an audible or visible alarm unit or the like.

A plurality of output devices 16*b* is coupled to medium 12. The devices 16*b* can, without limitation, include audible or visible output devices, solenoid actuating devices and the like for carrying out a predetermined function in the region in which the system 10 is installed. If desired, output devices can also be incorporated into detectors 16*a*.

It will be understood that the exact details of the devices 16 are not limitations of the present invention. It will also be understood that the communications medium 12 could include a variety of two-wire or four-wire cable communications systems without departing from the spirit and scope of the present invention.

The system 10 is, in accordance with the present invention, particularly advantageous in that existing two-wire/four-wire communications cables 12 can be used with up-graded control elements 14 and upgraded detectors 16*a* to provide functionality beyond that heretofore known for such systems. In this regard, element 14 can form a status requesting command, generally indicated at 20 in FIG. 1 and transmit same by a medium 12 to devices 16.

Those devices which are exhibiting a status corresponding to command 20 can in turn reply to element 14 by coupling an electrical or optical signal to medium 12 of a predetermined magnitude which is indicative of the respective device, such as device 16*a*-1 exhibiting the requested status. In the event that multiple devices exhibit the requested status, the respective reply signals will be coupled to the medium 12 substantially simultaneously and cumulatively whereupon element 14 can detect the cumulative reply signal and in turn establish from its amplitude the number of status indicating devices. For example, responding devices could shunt appropriate wires of a wired medium causing a current to flow therein.

It will be understood that element 14 could issue a variety of commands 20-1, 20-2 . . . 20-n to the devices 16 requesting status or other information. In response to each of the commands 20-i, the respective replying devices can couple the same electrical or optical signal to the medium 12 as would be used to reply not only to other commands 20-1 . . . 20-n but also to indicate the presence of various conditions such as the presence of a predetermined ambient condition.

It will be understood by those of skill in the art that devices could receive commands via medium 12*a*, an electrical cable, and respond via medium 12*b*, a different electrical cable. Responses could include shunting or shorting a respective medium or coupling an electrical signal or multi-element message thereto.

Figure 2:
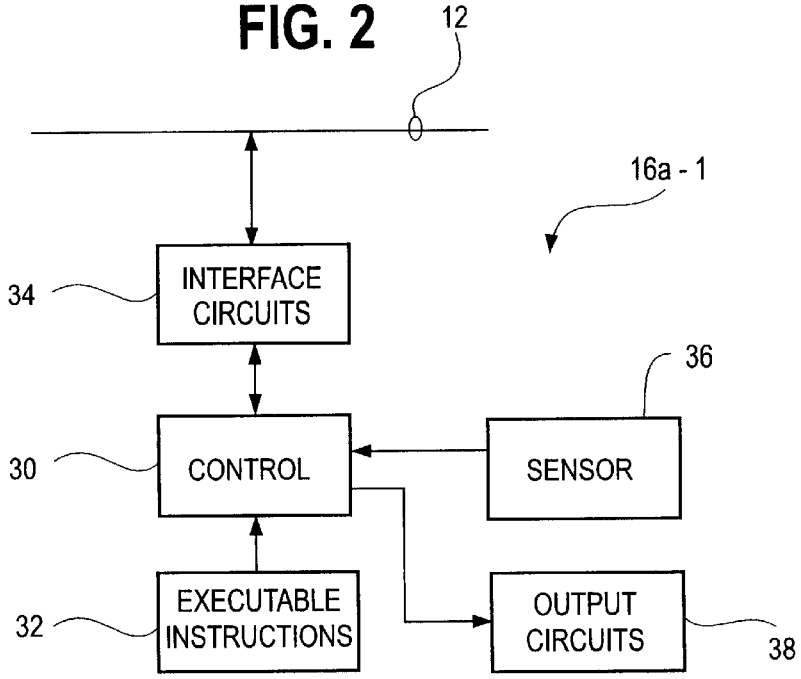
FIG. 2 is an over-all block diagram of a device usable with the system of FIG. 1.

FIG. 2 illustrates in block diagram form the detector 16*a*-1. The detector 16*a*-1 includes control circuitry 30, which could include a programmed processor. Coupled to the processor is a plurality of executable instructions 32. Also coupled to the processor 30 are interface circuits 34 which enable the detector 16*a*-1 to communicate via the medium 12 with the element 14. It will also be understood that some or all of the members of the plurality 16 could include an application specific integrated circuit, ASIC, instead of or in addition to a programmed processor.

Detector 16*a*-1 also incorporates an ambient condition sensor 36 which could, for example and without limitation, correspond to a flame sensor, a smoke sensor, a thermal sensor, a flow sensor, a position sensor, a motion sensor or the like without limitation. It will also be understood that multiple sensors can be incorporated into a detector or device 16 without departing from the spirit and scope of the present invention.

In the event that the device is to also carry out an output control function, output circuits 38 can be provided coupled to the control processor 30. In such instances, the respective device need not include the sensor 36.

In accordance with the present invention, the devices 16 are downward compatible with monitoring systems which do not include software or executable instructions to issue status commands such as the commands 20-1 . . . 20-n.

In such instances, the respective devices monitor respective ambient conditions and couple signals indicative thereof to the medium 12.

The control element 14 also incorporates reset circuitry for interrupting electrical energy provided to the devices 16 for predetermined periods of time thereby resetting same in response to the devices replying either to the commands 20-1 . . . 20-n or going into an alarm state in response to a detected adjacent ambient condition. Other types of reset signals could also be used.

From the foregoing, it will be observed that numerous variations and modifications may be effected without departing from the spirit and scope of the invention. It is to be understood that no limitation with respect to the specific apparatus illustrated herein is intended or should be inferred. It is, of course, intended to cover by the appended claims all such modifications as fall within the scope of the claims.

What is claimed:

1. A dual mode fire detector usable in first and second different types of alarm systems, the first type of system having a control unit coupled by a cable to a plurality of detectors wherein the detectors, on detecting a fire condition, exhibit a latched alarm indicating condition on the cable, producing a predetermined current flow on the cable, wherein the current flow is detectable by the control unit as an indication of an alarm condition and wherein the control unit interrupts the alarm indicating current flow thereby resetting all of the detectors substantially simultaneously, and, wherein the second type of system has a different control element coupled to a second cable and alarm indicating fire detectors are coupled to the second cable, wherein the fire detectors each produce a current flow in the second cable in response to a fire and wherein the different control element includes circuitry for sending at least one status requesting message to the detectors via the second cable wherein the detectors exhibiting the requested status respond to the different control element's status requesting message by each producing the same current flow on the second cable as the respective detector would produce thereon to indicate a fire, the dual mode detector comprising:

a fire sensor;

control circuits, coupled to the sensor and couplable to a communication cable, wherein the control circuits receive fire indicating signals from the sensor and status requesting signals from the cable, wherein the control circuits produce a current flow on the cable to indicate a fire condition and the same current flow is produced on the cable, in response to a received status request, to indicate the existence of the requested status, and where in the absence of status requesting signals, only a fire, sensed by the fire sensor produces the current flow.

2. A detector as in claim 1 wherein the current flow is produced by the control circuits exhibiting a change from a first impedance to a second impedance.

3. A detector as in claim 1 wherein the current flow produced in response to a status requesting signal is produced until electrical energy flowing to the control circuits is interrupted.

4. A device for communicating status in an alarm or security system which includes:

first circuitry to generate at least one output signal, and second circuitry for receiving at least one status request signal, and wherein the first circuitry will generate the output signal in response to receipt of the status request signal if the device is exhibiting a non-alarm status which corresponds to the received status request and wherein at least the first circuitry will generate the output signal independently of the status request signal if the device is exhibiting an alarm condition.

5. A device as in claim 4 wherein the output signal is generated by a change in an impedance value of the first circuitry from a first impedance value to a lower, latched impedance value.

6. A device as in claim 5 wherein the change in impedance value produces a current flow.

7. A device as in claim 4 wherein the device exhibiting the respective status will send the status indicating output signal during at least a predetermined time period following the received status request signal.

8. A device as in claim 4 which includes terminals for coupling to a wired communications medium; and wherein the output signal generated by the first circuitry is a latched signal which is reset by interrupting electrical energy received from the wired medium.

9. A device as in claim 4 which includes at least one sensor selected from a class which includes at least a smoke sensor, a thermal sensor, a flame sensor, a gas sensor, an intrusion sensor, a position sensor, a motion sensor, and a flow sensor.

10. An ambient condition detector usable in two different types of monitoring systems wherein one system includes functions not present in the other, the detector comprising:

an ambient condition sensor; and control circuits, coupled to the sensor and couplable to a wired medium, wherein the control circuits receive condition indicating signals from the sensor, and, status requesting signals from the medium, wherein the control circuits go from a first output state to a second output state in response to the existence of a predetermined ambient alarm condition, and the same change from the first to the second output state is exhibited in response to a received status request, to indicate the existence of the requested status, and, where in the absence of status requesting signals, only the sensed, predetermined ambient alarm condition produces the same change in output state.

11. A detector as in claim 10 wherein the control circuits include further circuitry whereby the second output state is a latched state whereupon the latched second output state can only be reset to the first output state by interrupting a flow of electrical energy to at least the control circuits.

12. A monitoring system comprising a communications medium;

a plurality of detectors coupled to the medium wherein each detector comprises an ambient condition sensor; and control circuits, coupled to the sensor and couplable to a wired medium, wherein the control circuits receive condition indicating signals from the sensor and status requesting signals from the medium, wherein the control circuits go from a first output state to a second latching output state in response to the existence of a predetermined ambient alarm condition, and the same change of output state is exhibited in response to a received status request, to indicate the existence of the requested status, and, where in the absence of status requesting signals, only the sensed, predetermined ambient alarm condition produces the change in output state; and wherein the communications medium is serially couplable to each of first and second common control units without modifying any of the detectors, wherein the first control unit detects current flowing in the medium in response only to at least one detector exhibiting an alarm condition and wherein the first control unit communicates with the detectors by resetting all detectors in the system, thereby interrupting the current flow and wherein the second control unit detects current flowing in the medium in response to at least one detector exhibiting an alarm condition, and also at a different time, detects the same current flowing in the medium, after sending a status request to the members of the plurality provided that the at least one detector is exhibiting the requested status.

13. A system as in claim 12 wherein the change in output states corresponds to a change in an impedance value of the control circuit from a first impedance value to a lower impedance value.

14. A system as in claim 13 wherein the change in impedance value produces a current flow.

15. A system as in claim 14 which includes a system control unit for resetting the detectors from the latched second state to the first state.

16. A system as in claim 12 which includes at least one sensor selected from a class which includes at least a smoke sensor, a thermal sensor, a flame sensor, a gas sensor, an intrusion sensor, a position sensor, a motion sensor, and a flow sensor.

17. A device for communicating status in an alarm or security system which includes:

first circuitry to generate at least one output signal, and second circuitry for receiving at least one status request signal, and wherein the first circuitry will generate the output signal in response to receipt of the status request signal and wherein at least the first circuitry will generate the output signal independently of the status request signal if the device is exhibiting an alarm condition;

thus allowing the device to operate in at least two different types of systems.

18. A device as in claim 17 wherein the at least two different types of systems include a first system that generates status request signals and a second system that does not generate status request signals.

19. A device as in claim 18 wherein the device only provides alarm signals in the second system and the second system does not generate status request signals.

20. A device as in claim 18 wherein the device provides alarm signals and non-alarm status request signals in the first system and the first system generates status request signals.

21. A device as in claim 17 wherein the at least two different types of systems include a first system that generates status request signals and has additional circuitry for use in a second system that does not generate status request signals.

22. A device as in claim 17 wherein the output signal is generated by a change in impedance value of the first circuitry from a first impedance value to a lower impedance value.

23. A device as in claim 17 wherein the device exhibiting a respective status will send the respective status indicating the output signal during a predetermined time period following the received status request signal.

24. A device as in claim 17 which further comprises at least one smoke sensor.

25. A device as in claim 24 which further comprises at least one of a thermal sensor, a flame sensor, a gas sensor, an intrusion sensor, a position sensor, a motion sensor, and a flow sensor.

* * * * *